US005209790A

United States Patent [19]

Wojcik

[11] Patent Number: 5,209,790

[45] Date of Patent: May 11, 1993

[54] PRODUCTION OF TI-V-CR HOMOGENEOUS ALLOY WITHOUT VANADIUM INCLUSIONS

[75] Inventor: Chester C. Wojcik, Salem, Oreg.

[73] Assignee: Teledyne Industries, Inc., Albany, Oreg.

[21] Appl. No.: 833,661

[22] Filed: Feb. 11, 1992

Related U.S. Application Data

[63] Continuation of Ser. No. 409,505, Aug. 15, 1989, Pat. No. 5,124,122.

[51] Int. Cl.[5] ..... B21D 21/00

[52] U.S. Cl. ..... 148/421; 148/538; 420/419; 420/421

[58] Field of Search ..... 148/421, 538; 420/419, 420/421

[56] References Cited

U.S. PATENT DOCUMENTS

| | | | |
|---|---|---|---|
| 3,565,602 | 2/1971 | Konisi et al. | 75/10.26 |
| 3,645,727 | 2/1972 | Finlay et al. | 75/175.5 |
| 3,673,038 | 6/1972 | Canonico et al. | 29/195 |
| 4,951,735 | 8/1990 | Berczik | 164/138 |

FOREIGN PATENT DOCUMENTS

| | | |
|---|---|---|
| 2064276 | 9/1970 | France . |
| 1175683 | 12/1969 | United Kingdom . |

*Primary Examiner*—Upendra Roy
*Attorney, Agent, or Firm*—Shoemaker & Mattare, Ltd.

[57] ABSTRACT

A method of making a Titanium, Vanadium and Chromium alloy substantially free of Titanium-Chromium phases and inclusions of undissolved Vanadium including the steps of alloying preselected amounts of Vanadium and Chromium to produce a stable phase alloy substantially free of unalloyed Chromium or Vanadium and then mixing and melting the stable phase alloy together with a preselected amount of Titanium to produce the final alloy composition.

7 Claims, 3 Drawing Sheets

PRODUCTION OF TI-V-CR HOMOGENEOUS ALLOY WITHOUT VANADIUM INCLUSIONS

This is a continuation of application Ser. No. 07/409,505, filed Aug. 15, 1989 now U.S. Pat. No. 5,124,122.

BACKGROUND OF THE INVENTION

This invention relates to Titanium alloys and, more particularly, to alloys containing Titanium, Vanadium and Chromium.

High strength Titanium alloys have been produced containing about 50% by weight of Titanium, up to about 35% by weight Vanadium, and up to about 15% by weight of Chromium. Some of these alloys contain trace and minor amounts of additives such as Silicon and Carbon and other elements. Such alloys are characterized by exhibiting a stable second phase in the microstructure and superior elevated temperature strength.

Conventionally, these high strength alloys are prepared by vacuum arc melting of an electrode made up of electron beam welded compacts of blended Titanium and preselected amounts of Vanadium and Chromium and other additions.

This vacuum arc melting process, while generally acceptable, has a major drawback where inclusions of undissolved Vanadium are sometimes found in the finished ingot. This condition cannot be eliminated successfully with stirring coils on the furnace or with as many as three or four successive vacuum arc remelts of the ingot. It is believed that the problem persists because the higher melting temperature of Vanadium in the presence of a significantly lower melting Titanium and Chromium alloy resists dissolution. Prior attempts to avoid this problem have included the addition of Vanadium in the form of thin chips to facilitate dissolution. While this reduces somewhat the frequency of occurrence of Vanadium inclusions, undissolved Vanadium was still encountered.

It is, therefore, an object of the present invention to prevent inclusions of Vanadium in the finished ingot or to substantially reduce the occurrence of Vanadium inclusions in high strength alloys containing Titanium, Vanadium and Chromium.

It is a further objective of the present invention to prevent the formation of a low melting Titanium-Chromium alloy during the production of a Titanium-Vanadium-Chromium alloys.

SUMMARY OF THE INVENTION

The foregoing and further objects and advantages are obtained in the production of high strength alloys containing Titanium, Vanadium and Chromium by prealloying the Vanadium and Chromium in the desired proportions (e.g., about 70% Vanadium and about 30% Chromium) by melting them together in a vacuum arc furnace at a temperature in the range of from about 1800° C. to about 1900° C. for a sufficient period of time and under conditions which substantially completely forms a Vanadium-Chromium alloy where all of the Vanadium and Chromium are dissolved in a stable alloy phase. The alloy thus formed is then reduced in size to predetermined particle sizes, and then mixed with a preselected amount of sized Titanium particles, compacted and formed into an electrode and melted in a vacuum arc furnace to form the desired Titanium-Vanadium-Chromium alloy without any significant alloy formation of a low melting Titanium-Chromium alloy and without the inclusions normally present in such an alloy resulting from the presence of undissolved high melting Vanadium.

The present invention, as described, effectively decreases the melt temperature of the Vanadium through the formation of a Vanadium-Chromium alloy which has a lower melting temperature than the melting point of Vanadium. Further, the absence of unalloyed Chromium in the Vanadium Chromium alloy formed, substantially eliminates the formation of a low melting Titanium-Chromium alloy in which unalloyed Vanadium resists dissolution. The prealloying process of the present invention thereby avoids those conditions which presently favor the presence of unalloyed, undissolved Vanadium, substantially eliminating the formation of Vanadium inclusions in the finished high strength Titanium-Vanadium-Chromium alloy.

DETAILED DESCRIPTION OF THE INVENTION

The Titanium-Vanadium and Chromium alloy produced according to this invention achieves its relatively inclusion-free structure by the addition of a Vanadium-Chromium master alloy to the Titanium rather than simply melting compacts consisting of a mixture of the elemental metals.

Figure 2:
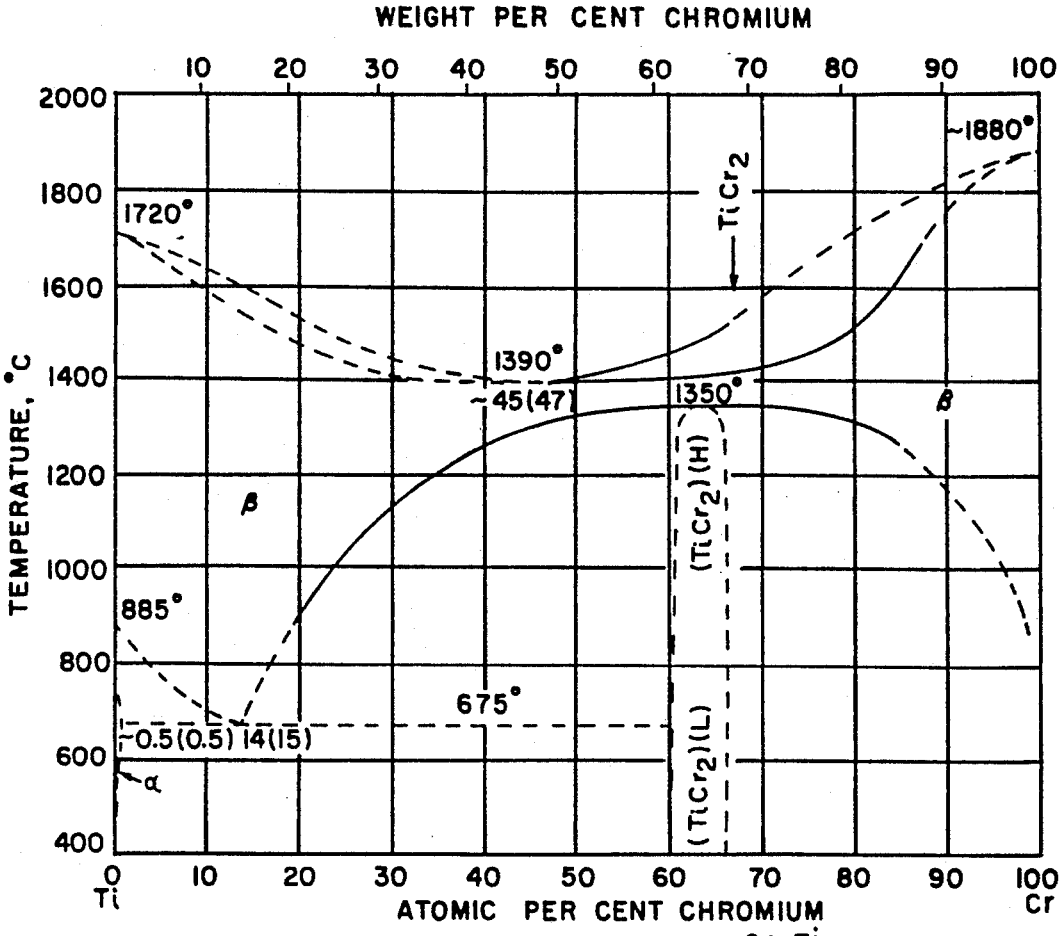
FIG. 2 is a phase diagram of the various alloy phases of Titanium-Chromium alloy compositions and their melting temperatures.
Figure 1:
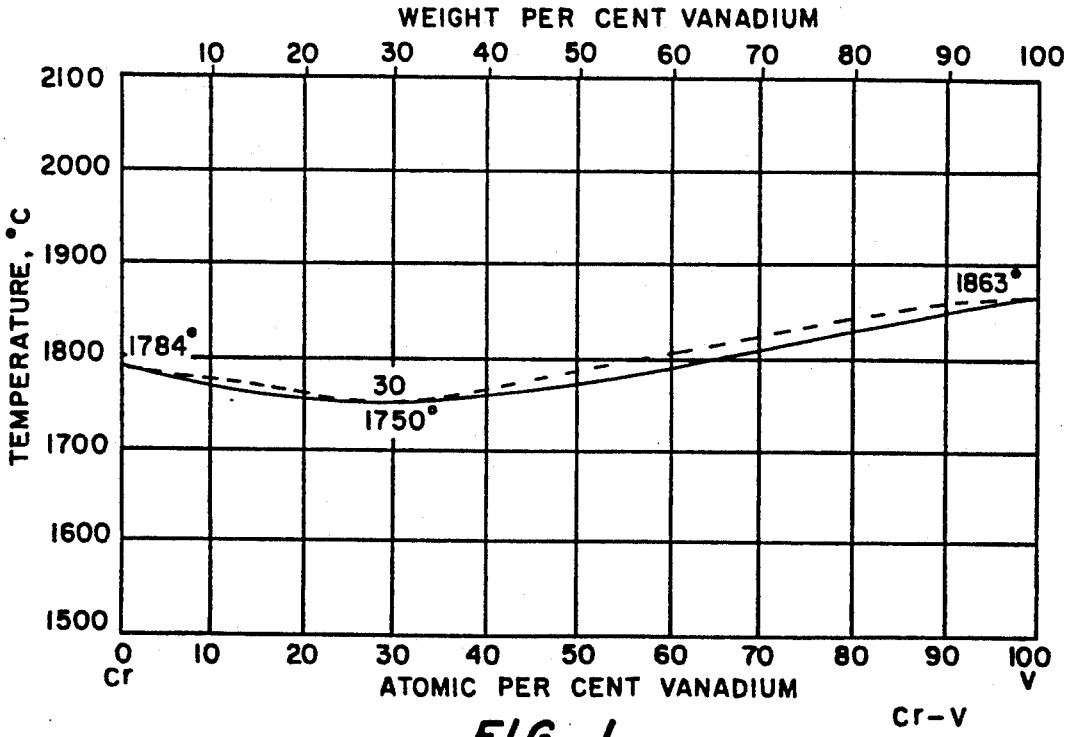
FIG. 1 is a phase diagram of Chromium-Vanadium alloys showing the melting temperature of various alloy compositions.

Referring to FIG. 1, the temperature of the melting point of the prealloyed Vanadium-Chromium alloy containing approximately 70% by weight Vanadium and 30% by weight Chromium is about 1,800° C. Referring to FIG. 2, it can be seen that the possible Titanium-Chromium alloy that can be present when there are elemental additions, are substantially lower melting than the Vanadium-Chromium alloys and, most importantly, much lower melting than elemental Vanadium. As previously described, the formation of low melting Titanium-Chromium alloys are believed to be responsible for preventing the full or complete dissolution of the much higher melting Vanadium.

The following examples will further characterize the practice and advantages of the present invention.

EXAMPLE 1

Eleven inch diameter compacts were prepared starting with 0.020" thick chopped Vanadium chips, and ¼"

Chromium nuggets containing about 1,000 ppm C. The compacts were Electron Beam welded together by conventional practice to make arc melt furnace electrodes for use in the normal vacuum arc melting practice.

Two first melt 14" diameter ingots, having a composition of 70% by weight Vanadium and 30% by weight Chromium, weighing 2,000 lb. each, were melted under full vacuum at 10,000 amps. Both first melts produced ingots that had a skull on the outside which turned out to be about 95% Chromium. The skull was not removed. The two first melts were final melted into two 17" diameter ingots at 15,000 amps.

A similar composition was also compacted and vacuum arc melted in the same manner to form two ingots at full vacuum with the high Chromium skull appearing again. The ingot was scalped to remove the high Chromium layer. A ½" thick slice was removed at mid-length and analyzed. The saw cut faces were sampled radially. The ingot was uniform in composition across the diameter containing about 72% Vanadium and 28% Chromium.

Two second melts of the same composition was compacted and vacuum arc melted under the same conditions as the first melt ingots except that 21" vacuum was employed in an inert atmosphere containing a mixture of ⅓ Helium, ⅔ Argon, to suppress Chromium evaporation during arc melting. No skull was observed on the second melt and radial sampling at mid-length confirmed an alloy comprising about 70% Vanadium and 30% Chromium.

Both the latter second melt ingots were heard to be cracking and were both cracked in the top face when pulled from the arc furnace.

The latter second melt ingots containing about 70% Vanadium and 30% by weight Chromium were dry machined on a lathe to chips to about a 13" diameter core with tool steel bits at about 0.025" feed. Those chips were roll crushed to about ½ square turnings and not screened.

The two 13" diameter ingot cores were then crushed to approximately ½" chunks. The inside core of both ingots was cracked to the extent that they were not chipping well and crushing rather than machining was tried. The chunks including crushed core were hammer-milled. Approximately 70% of the hammer-milled material passed through a 6 mesh screen. Oversized material was rehammermilled such that all the material passed through a 6 mesh screen. It was observed that the smooth faces of the roll crusher did not crush the alloy at an acceptable rate.

The 6 mesh Vanadium-Chromium alloy and chipped alloy was then used in the preparation of two Titanium alloy compacts. The Titanium employed was in the form of Titanium sponge sized to about ¾" pieces.

The constituents were blended and then pressed into 6 ½" diameter compacts weighing about 25 lbs. each. The proportion of Titanium sponge was about 50% by weight to about 50% by weight of the 70-30 Vanadium-Chromium alloy. Additional elemental Chromium can be added, and was added to the first melt material to compensate for evaporation losses in the production of the first melt Vanadium-Chromium alloy. The volume of Titanium was about 2 times that of Vanadium-Chromium alloy. The chipped alloy compacted better and segregated less than the crushed 6 mesh alloy.

The second melt Vanadium-Chromium alloy in 6 mesh and chipped forms was used in the preparation of two more Titanium alloy compacts using ¾ inch Titanium sponge and having the same approximate composition as the Titanium alloy prepared using the first melt ingots. In this case, the precautions taken against Chromium evaporation loss eliminated the necessity of adding additional elemental Chromium metal to the blended material before compacting.

EXAMPLE 2

Using an arc melting furnace, a series of four Titanium-Vanadium-Chromium ingots were triple arc melted using different forms of elemental Vanadium and the Vanadium Chromium prealloys then prepared for the first and second melts in Example 1. The primary objective was to qualitatively investigate alternative means of adding the Vanadium to avoid undissolved inclusions. All of the ingots were melted into a 3" diameter pot using 2,000–2,400 amps of current. Electrodes were prepared from 2" diameter mechanical compacts which were welded together. Four ingots were produced having the following makeup:

1) The proper preselected proportions of Titanium sponge (¾ inch) and Chromium (¼ inch) and thick Vanadium chips for a Titanium 55% by weight; Vanadium 30% by weight and Chromium 15% by weight alloy, were used as is conventional practice.
2) Same as 1) except thin Vanadium chips about 0.01–0.02 thick × ½" wide were used.
3) Same as 1) except −10 mesh Vanadium powder was used.
4) A Vanadium-Chromium alloy in the form of chips or crushed product as prepared in Example 1 with 55% titanium sponge.

The Vanadium-Chromium alloy was melted together in the form of buttons which were easily crushed to ½ mesh since this compacted well with the titanium sponge which was −¾" mesh.

Figure 3:
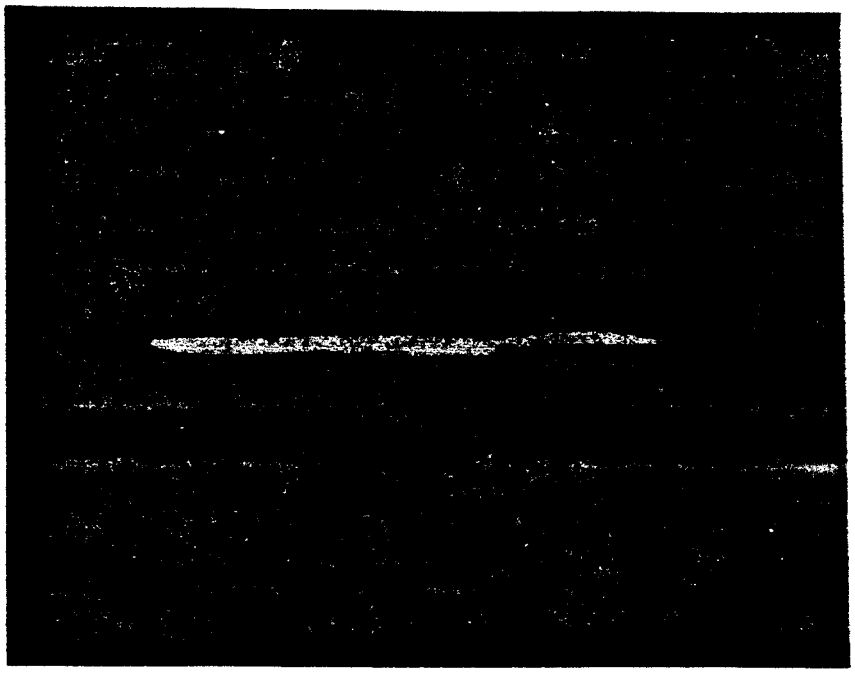
FIG. 3 is a photomicrograph at 50× magnification showing the typical Vanadium inclusion present in Titanium-Vanadium-Chromium alloys.
Figure 4:
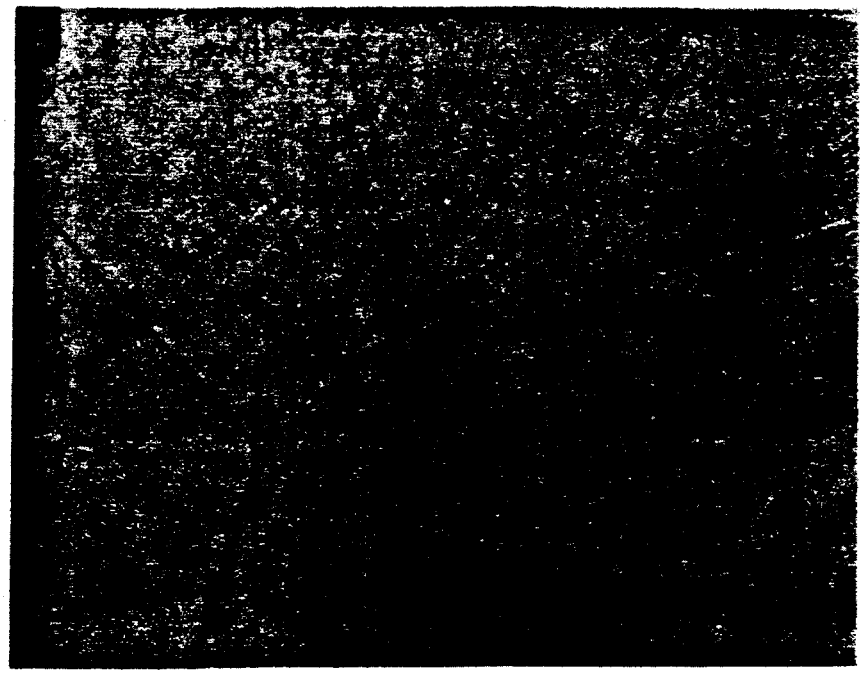
FIG. 4 is a photomicrograph at 100× magnification showing the microstructure of a Vanadium 30 Chromium master alloy.
Figure 5:
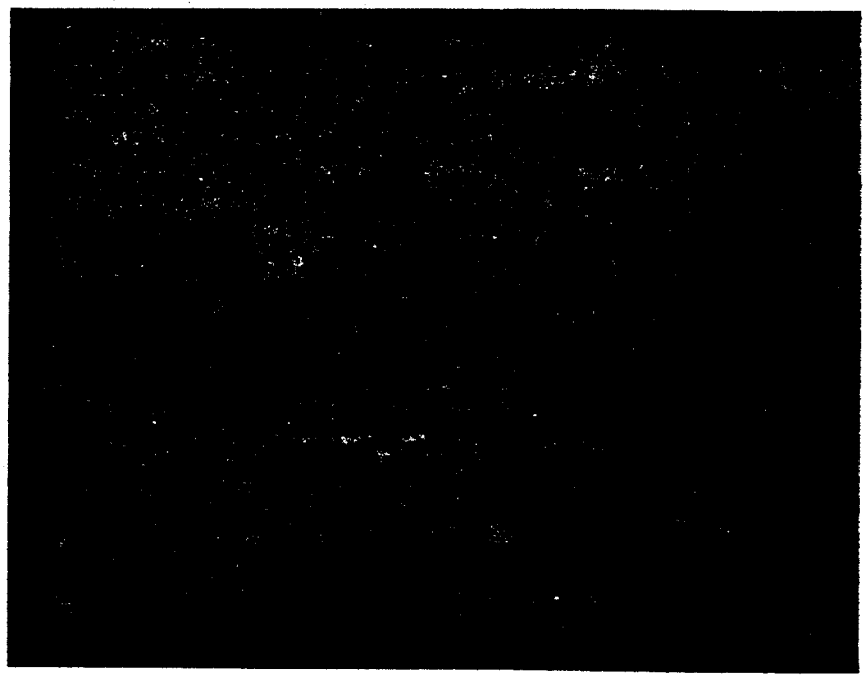
FIG. 5 is a photomicrograph at 500× magnification showing the microstructure of a Titanium-Vanadium-Chromium alloy prepared according to the present invention. Note that the gold colored particles are carbide rich phases which vary in concentration depending on the carbon content of the alloy. These should not be confused with unmelted vanadium or other undissolved components in the alloy.

Each of the ingots were sectioned lengthwise after each melt to view the extent of alloying that had taken place. Photographs of the ingots after each melt are shown in FIGS. 3, 4 and 5. As shown, all of the ingots contained large amounts of undissolved Vanadium or Vanadium-Chromium master alloy after the first melt. The inclusions, which are more dense than Titanium, tend to funnel towards the bottom and center of the ingot. It should be mentioned that no stirring coil was used during the arc melting. Even after the third melt, all of the ingots contained some undissolved material. It is apparent that a thinner Vanadium chip, or the use of Vanadium powder leads to fewer and smaller Vanadium inclusions. It is also shown that the 70 Vanadium-30 Chromium alloy seems to dissolve as well as the pure Vanadium chips even though the alloy was much larger in size (½ mesh). It is concluded and subsequently verified that the 70% Vanadium-30% Chromium alloy produced significantly fewer undissolved particles when added in a more finely divided form. Also the Vanadium-Chromium buttons were both crushable and machinable.

The foregoing and further experimentation have confirmed that the master alloy containing about 70 weight percent Vanadium and 30 weight percent Chromium are easily melted together to form an alloy with few undissolved inclusions. Further, the alloy is easily crushable with convention equipment at room temperature. Typically, a press forge, jaw crusher, hammer mill, disk pulverizer and the like can be employed.

The particle size and the shape of the Vanadium, Chromium, and the Titanium are important depending on the melting process being used, to achieve the desired inclusion free microstructure in the final alloy.

The master alloy of Vanadium and Chromium can have a composition in the range of from about 60 to about 80 percent by weight Vanadium and from about 40 to about 20 percent by weight of chromium, it being appreciated that increases in the proportion by weight of chromium depresses the melting temperature and increases in the proportion of Vanadium raises the melting temperature of the master alloy. Minor variations in the proportions of vanadium and chromium can be tolerated and still achieve the advantages described herein when preparing the final Titanium, Vanadium, Chromium alloy. Of great importance to the practice of the present invention is the selection of particle sizes and melting method in combination with the proportions selected. The rate and method of melting is important to the selection of the size of the materials being dissolved during melting. In this regard, it is important that the master alloy be formulated so as to be capable of being easily reduced in size to a preselected size for incorporation into a compact or melt with the Titanium. It is, therefore, preferred to select the proportions more nearly to the optimum 70 percent by weight Vanadium and 30 percent by weight Chromium. This preferred master alloy is easily crushable by conventional means. By way of comparison, an 80% Vanadium, 20% Chromium master alloy will crack and deform plastically when strained at a low rate. While this would be considered difficult to crush, decreases in temperature or increases in the strain rate could be utilized to obtain more brittle fracture characteristics and the final size desired will depend on the melting method employed and the preselected particle size of the Titanium. To exemplify this statement, the vacuum arc remelting method described herein exposes the combined particles of Titanium and Vanadium and Chromium master alloy to very high temperatures (i.e., 1500°-2000° C.) for relatively short times ranging from minutes for large ingots to seconds for small ingots. Under these heating conditions, the time available for dissolving the Vanadium-Chromium master alloy is limited and a small particle size, i.e., minus 10 mesh, is preferred for both preparation of the master alloy and the Titanium-Vanadium-Chromium alloy. These conditions then require that a Vanadium-Chromium alloy be easily crushable.

If another melting method were selected, such as crucible or skull melting, it is anticipated that larger particle sizes could be employed with a diminished crushability requirement. Selection of melting method and the proportions in the master alloy to achieve a variety of Titanium-Vanadium-Chromium alloy compositions are interrelated and can be chosen without undue experimentation. The possible melting means and methods could, therefore, be selected from direct arc, plasma, induction, electron beam or laser as well as crucible and vacuum arc remelting.

It is contemplated that following the teachings contained herein that Titanium alloys containing from between about 45% by weight to about 55% by weight Titanium can be prepared using a master alloy containing between about 60% to about 80% by weight of Vanadium and between about 20% to about 40% by weight of Chromium so that the final Titanium alloy in the ranges of 45% to 55% by weight Titanium can contain between about 25% by weight to about 45% by weight Vanadium and from about 10% by weight to about 20% by weight of Chromium.

As described hereinbefore, when vacuum arc melting is employed as the melting method, it is very important to select conditions which minimize the vaporization of chromium when melting. The described procedure wherein a partial absolute pressure of inert gases such as Helium and Argon of about five psi or around 21 inches of mercury. As described, all of the described conditions, including melting method, alloy composition, melting conditions, and crushability and particle size of the Vanadium and Chromium alloy before melting and after crushing, all combine to produce the advantages of the master alloy when used in the preparation of the final, relatively inclusion-free, Titanium-Vanadium-Chromium alloy described.

The present invention has been described in sufficient detail to enable one skilled in the art to practice the invention. It is expected that variations in all the parameters discussed can be made without undue experimentation to achieve the described properties and advantages in the Vanadium-Chromium master alloy and the final Titanium-Vanadium-Chromium alloy. It is also contemplated that additional materials, such as carbon and silicon in the total amounts up to about 5 percent by weight of the final alloy, may be employed for specific working or metallurgical purposes to achieve specific physical property objectives without departing from the spirit and scope of this invention. The scope of this invention is only limited by the scope of the appended claims in view of the pertinent prior art.

I claim:

1. A method of producing a high strength Titanium, Vanadium and Chromium alloy comprising the steps of:
   (1) providing a compactable mixture of Vanadium and Chromium;
   (2) alloying the mixture of Vanadium and Chromium to product a stable phase alloy consisting essentially of Vanadium and Chromium which is substantially free of unalloyed Chromium or vanadium;
   (3) subdividing the Vanadium-Chromium alloy;
   (4) mixing preselected proportions of the subdivided Vanadium-Chromium alloy with a preselected amount of subdivided Titanium metal; and
   (5) melting the mixture of Titanium and Vanadium-Chromium alloy to provide a high strength Titanium-Vanadium-Chromium alloy substantially free of Titanium-Chromium phases and inclusions of undissolved Vanadium.

2. The method of claim 1 wherein the Vanadium Chromium alloy contains from about 60% by weight to about 80% by weight Vanadium and from about 40% by weight to about 20% by weight Chromium.

3. The method of claim 1 wherein the Titanium alloy consists essentially of from about 50% by weight to about 60% by weight of Titanium.

4. The method of claim 2 wherein the Vanadium-Chromium alloy contains about 70% by weight Vanadium and about 30% by weight Chromium.

5. A method of producing a high strength alloy containing Titanium, Vanadium and Chromium comprising the steps of:
   (1) compacting Titanium metal particles ranging in size from about 0.75" to about 0.010" with particles of a Vanadium-Chromium alloy ranging in size from about 0.50" to about 0.10"; under sufficient pressure to be self-supporting in finished compacted shapes;

(2) Vacuum arc melting said compact of Titanium and Vanadium-Chromium alloy under conditions sufficient to melt said Titanium and Vanadium-Chromium alloy together in a melt; and (3) Cooling the melt to form an ingot of a Titanium, Vanadium and Chromium alloy which is substantially free of inclusions of undissolved, unalloyed Vanadium metal.

6. The method of claim 5 wherein the Titanium metal is present in said compacted shape in amounts of from 50% by weight to about 60% by weight, the balance being Vanadium-Chromium alloy and up to 5% by weight of Silicon and Carbon.

7. The method of claim 6 wherein the Vanadium-Chromium alloy consists essentially of between about 60% by weight to about 80% by weight Vanadium and from between about 40% by weight to about 20% by weight of Chromium.

* * * * *